US007174897B2

(12) United States Patent
Gifford

(10) Patent No.: US 7,174,897 B2
(45) Date of Patent: Feb. 13, 2007

(54) HAIR STYLING APPARATUS AND METHOD FOR STYLING A PERSON'S HAIR

(75) Inventor: Catherine L. Gifford, Henderson, NV (US)

(73) Assignee: Scrunchit, Inc., Las Vegas, NV (US)

( * ) Notice: Subject to any disclaimer, the term of this patent is extended or adjusted under 35 U.S.C. 154(b) by 0 days.

(21) Appl. No.: 10/770,390

(22) Filed: Feb. 4, 2004

(65) Prior Publication Data

US 2004/0261810 A1 Dec. 30, 2004

Related U.S. Application Data

(60) Provisional application No. 60/482,771, filed on Jun. 27, 2003.

(51) Int. Cl.
*A45D 24/00* (2006.01)

(52) U.S. Cl. ..... 132/200

(58) Field of Classification Search ..... 132/200; 2/159, 167, 161.6, 16, 163, 164, 20, 21, 160, 2/161.1; 15/227; 34/283
See application file for complete search history.

(56) References Cited

U.S. PATENT DOCUMENTS 3,960,155 A * 6/1976 Wall ..... 132/212
4,843,652 A * 7/1989 Kuwahara ..... 2/167
5,082,010 A * 1/1992 Skaryd et al. ..... 132/201
5,121,762 A * 6/1992 DiPinto et al. ..... 132/204
5,286,477 A * 2/1994 Bhatt et al. ..... 424/47
5,826,595 A * 10/1998 Ramm et al. ..... 132/200
D422,758 S * 4/2000 Roche ..... D30/158
6,189,150 B1 * 2/2001 Jones-Roberson ..... 2/163
6,260,203 B1 * 7/2001 Battle ..... 2/161.6
6,863,883 B1 * 3/2005 Tsujino et al. ..... 132/202

FOREIGN PATENT DOCUMENTS

GB 2372424 A * 8/2002
JP 09313397 A * 12/1997
JP 11299684 A * 11/1999
JP 2002336034 A * 11/2002

* cited by examiner

*Primary Examiner*—John J. Wilson
*Assistant Examiner*—Robyn Doan
(74) *Attorney, Agent, or Firm*—Hunton & Williams, LLP; Daniel G. Vivarelli, Jr.

(57) ABSTRACT

A glove can be worn on a person's hand and, using several different techniques, can be used in styling a person's hair to produce curly or straight hair. The glove can be used to curl hair in a fist closing-type motion while hot drying air is applied. Hair may also be curled around the fingers, or the fingers may be used to put tension on hair to straighten it.

18 Claims, 6 Drawing Sheets

HAIR STYLING APPARATUS AND METHOD FOR STYLING A PERSON'S HAIR

This application claims priority from U.S. provisional patent application Ser. No. 60/482,771 filed Jun. 27, 2003.

BACKGROUND OF THE INVENTION

This invention relates to the field of personal grooming products and methods, and more particularly to apparatuses for and methods of styling a person's hair.

Many people desire to style their hair in a manner that enhances the hair's curliness and attractiveness. Of course, hair styling methods that are simple and quick are preferred.

This invention provides a method of styling a person's hair using an absorbent glove to manipulate the wet hair while applying drying hot air. This method results in styled hair that possesses attractive and natural looking curls. The method is relatively simple and quick.

DETAILED DESCRIPTION

Figure 1:
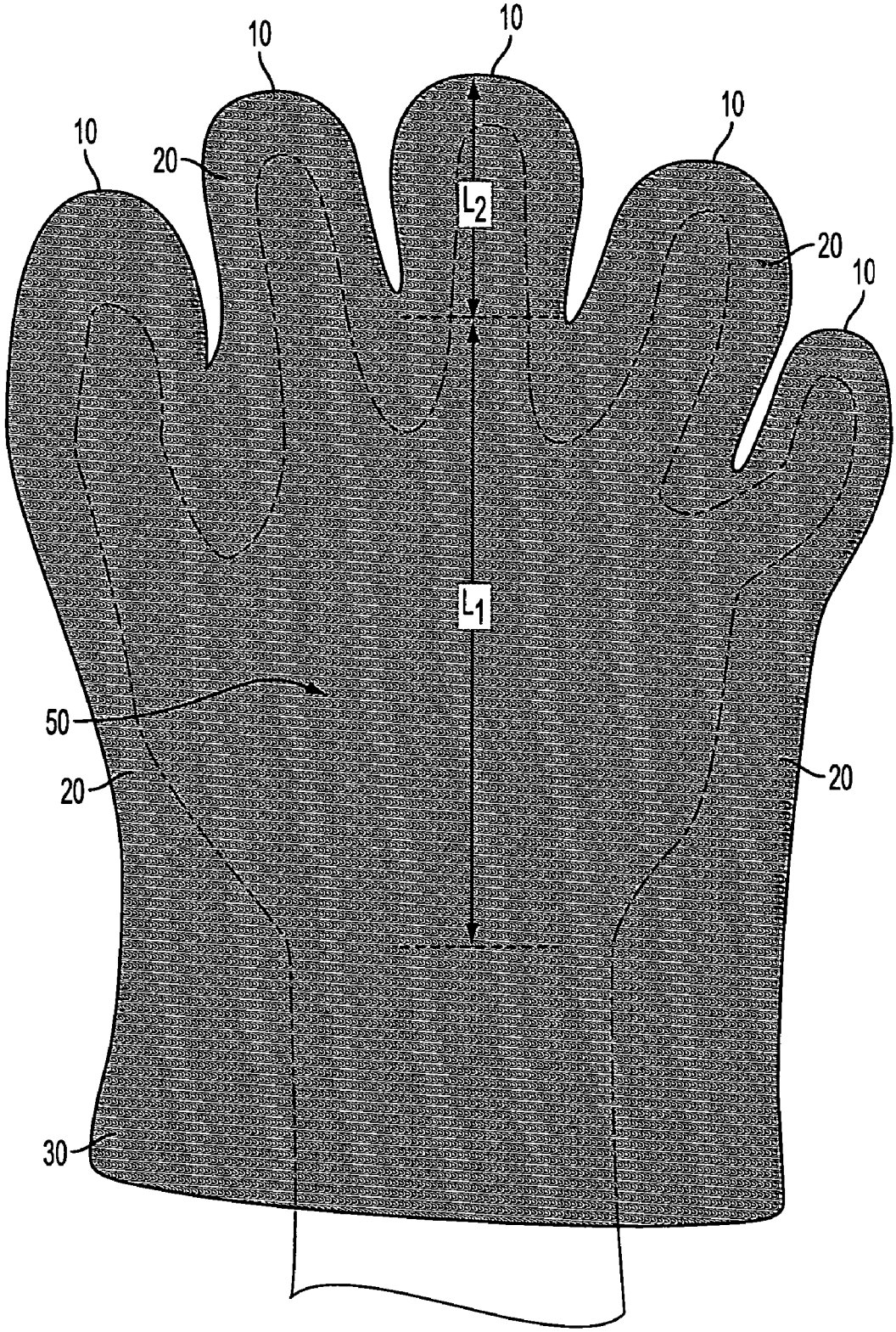
FIG. 1 illustrates schematically a plan view of a glove according to the present invention.

This invention provides both a method of styling hair, and a glove for use with the method. The principles of the method and the glove are described below through descriptions of preferred embodiments and through reference to the embodiments depicted in the drawing figures. It should be understood that the scope of the invention is not intended to be limited to these embodiments. Those of skill in the art will be able to produce embodiments different from the embodiments described and depicted herein in order to better suit varying needs or preferences.

The term glove is used herein in a broad sense to mean any flexible, sheet-like material that is passively and selectively held on a person's hand and covers a portion of the person's hand. Thus, the term glove can refer to a traditional glove which almost completely covers the hand and has separate fingers, a mitt which almost completely covers the hand but does not have separate fingers, a portion of material which covers one side of the hand and is attached to the hand with an elastic band which extends around the other side of the hand, or any other portion of material that is passively held on the hand.

One embodiment of the glove is illustrated in use by a person in FIGS. 2–5. This glove is illustrated by itself in schematic form in FIG. 1. In this embodiment of a glove, the glove includes material which substantially covers a person's entire hand, and includes separate fingers 10. In other embodiments, the glove may not cover a person's entire hand. Also, in other embodiments the glove may not include separate fingers 10.

One aspect of the invention, which will be described in more detail later, is the provision of an absorbent material in the glove for absorbing water from a person's wet hair while styling the hair. In the embodiment shown in FIG. 1, all of the glove's outside surface is covered with absorbent layer 20 made from an absorbent material. However, in other embodiments, there may be some part of the outside surface of the glove that is not covered with an absorbent material. The material of absorbent layer 20 should absorb at least water when it comes into contact with a person's wet hair. It may also be beneficial if absorbent layer 20 can absorb other liquids which may be found on the hair. For example, a fixing agent for fixing the shape and style of a person's hair may be present on the person's hair when styling. Some absorption of the fixing agent by the glove may permit the glove to distribute the fixing agent throughout the hair. One absorbent material which may be used for absorbent layer 20 is woven or knit terry cloth made from cotton or other natural or synthetic fibers. One advantage of terry cloth made from cotton is that it can be easily laundered for multiple uses of the glove.

The illustrated glove includes a forehand portion 30, a backhand portion 40 (on opposite side of glove shown in FIG. 1 and, therefore, not visible in FIG. 1), and five fingers 10 attached to the forehand portion 30 and the backhand portion 40. Again, the principles of the invention may be practiced with gloves of different shapes to suit particular needs. The glove is somewhat oversized, or larger than the person's hand, to provide a maximum amount of area for handling and manipulating the hair. Also, the length of the fingers is somewhat small compared to the overall size of the glove in order to maximize the palm area 50 of the glove. As described below, one technique that can be practiced with the glove emphasizes the closing the palm area 50 around the hair. Thus, with this technique the relatively enlarged palm area 50 can be an advantage. In the illustrated glove and as shown in FIG. 1, the length $L_1$ of the palm area 50 measured from the start of the middle finger to the point where the end of a person's palm (at the person's wrist) would reside inside the glove is approximately 4¼ to 5¼ inches, or more preferably 4½ to 5 inches. The length $L_2$ of the middle finger 10 is approximately 1¾ to 2¾ inches, or more preferably 2 to 2½ inches. A broken line outline of a person's hand situated inside the glove is shown in FIG. 1 showing that the fingers 10 of the glove are substantially shorter than the person's fingers.

The glove can be used when styling a person's hair. Several techniques for using the glove to style a person's hair are described below.

Ideally the person's hair is first washed with shampoo before styling, but is at least wetted. While the person's hair is wet, a wide-toothed comb or fingers can be used to comb through the hair. When a person's hair is wet, the hair generally will gather into clumps where many hair strands are held together by cohesion in a group of aligned hair strands. The combing should try to minimize separating the clumps of hair.

The glove can then be used to manipulate the hair into a desired shape while hot air is applied to dry the hair. With different techniques, the glove can manipulate the hair to produce curly hair or straight hair, as desired.

Figure 2:
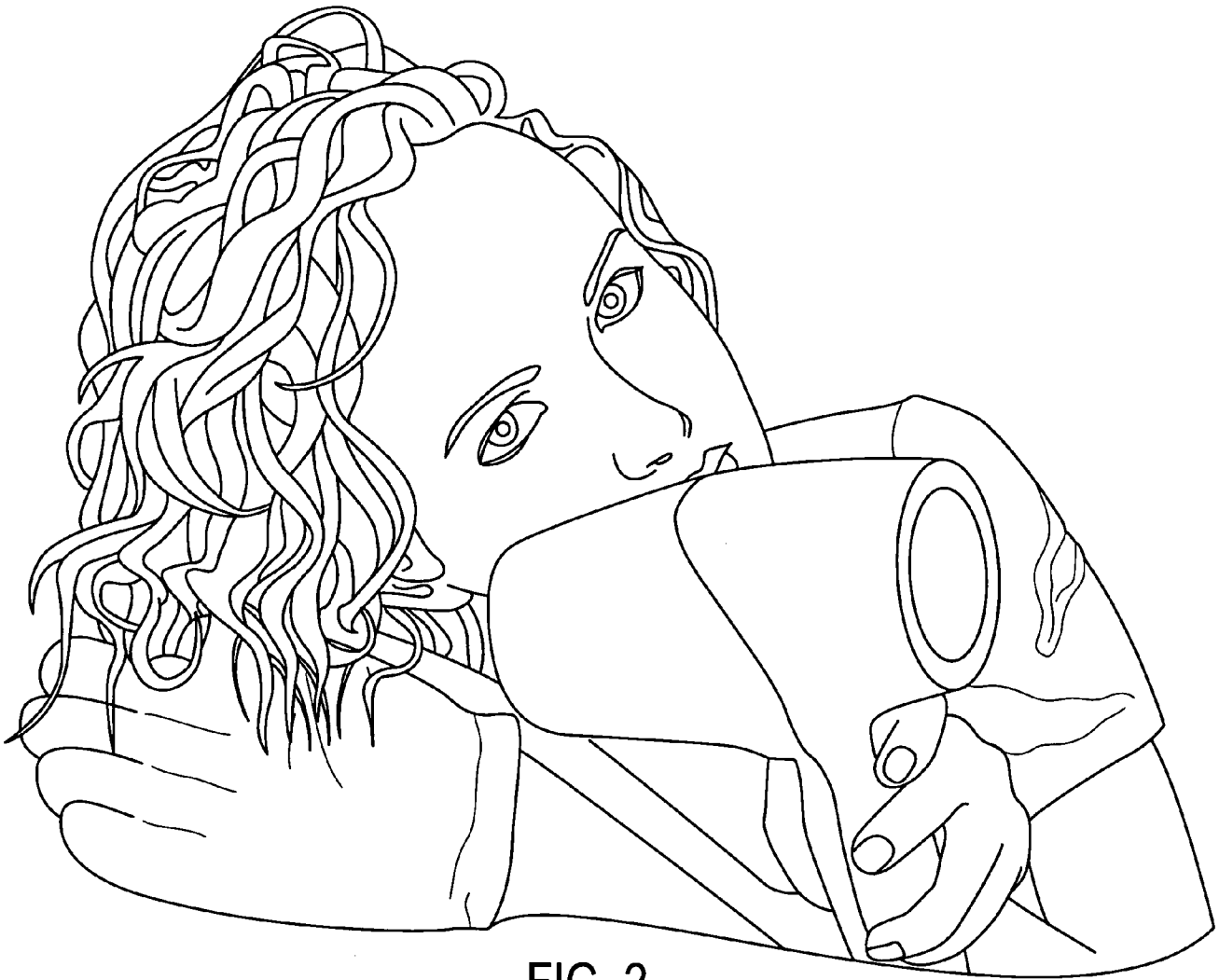
FIGS. 2–3 illustrate a technique which can be used in conjunction with the glove of FIG. 1 for styling curly hair wherein the hair is gently compressed into curls by repeatedly closing the glove partly into a fist around the hair.
Figure 3:
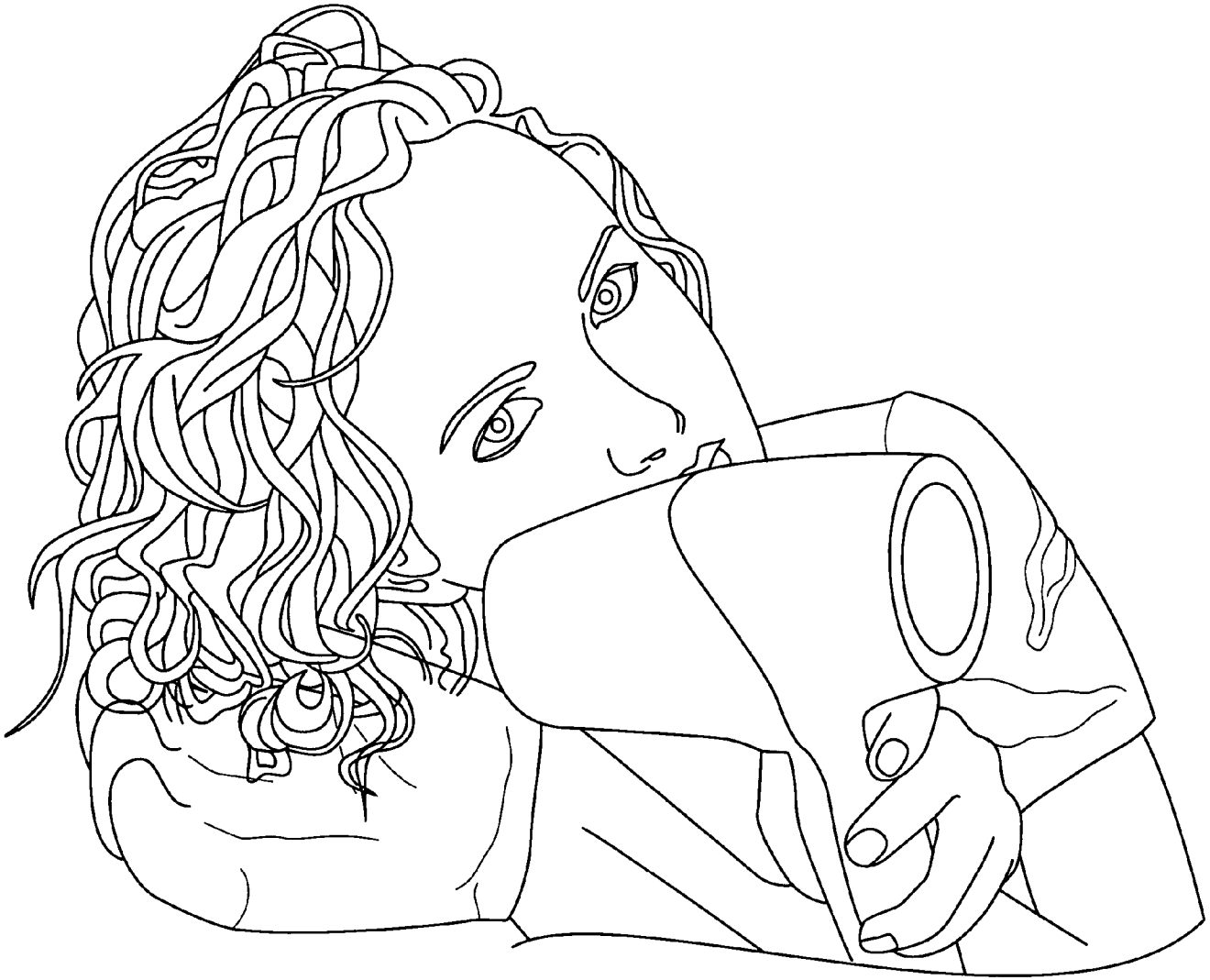

One technique for producing curly hair is closing the glove (i.e., closing the hand of the person using the glove partly into a fist) around a person's hair, as shown in detail in FIGS. 2 and 3. FIG. 2 shows the glove in position to begin lifting and supporting a portion of hair. FIG. 3 shows the glove closed around the hair and gently holding and squeezing the hair while hot air is applied to dry the hair. The glove can hold the hair in this position for a few seconds for drying, then release and close around a different portion of hair to repeat the process. Because the hair is held primarily in the palm area 50 of the glove, an enlarged palm area 50 can be beneficial.

With straight hair, the closing motion of the glove gently supports the hair and bends it into loose curls. With hair already having a tendency to curl, the closing motion enhances the curls by compressing the curls in the hair and causing them to tighten, meaning that the radii of the curls becomes smaller. This technique of creating, tightening, or enhancing the curls in the hair is more effective than many other methods for styling hair because with this technique the curls produced in the hair closely match the tendency, if any, of the hair to curl at a certain point, or in a certain direction. Because the hair is relatively unconstrained when it is compressed and bent into curls, the hair will bend in the manner that provides the least resistance to the pressure of the glove, i.e., in the manner that the hair curls naturally. When hair is curled with a curling iron or rollers, the hair is generally forced to curl in a certain direction and at a certain point. With this technique, the hair can be curled more naturally. The curls resulting from this technique are more sustainable and easier to achieve because they are more natural.

If the wetted hair has been left in clumps as described above, the closing motion does not tend to undesirably separate the clumps of wet hair. The clumps can thus remain together to a desirable extent even until the hair is dry. It is thought that the curls will be more sustainable than otherwise if the hair remains more or less in clumps so that cohesion between individual strands will allow the hair strands to support one another. In addition, many people simply find the look of curls of hair in relatively large clumps to be visually attractive. It can be more difficult with other methods of styling hair for the clumps of wet hair to remain intact during styling and drying.

Figure 4:
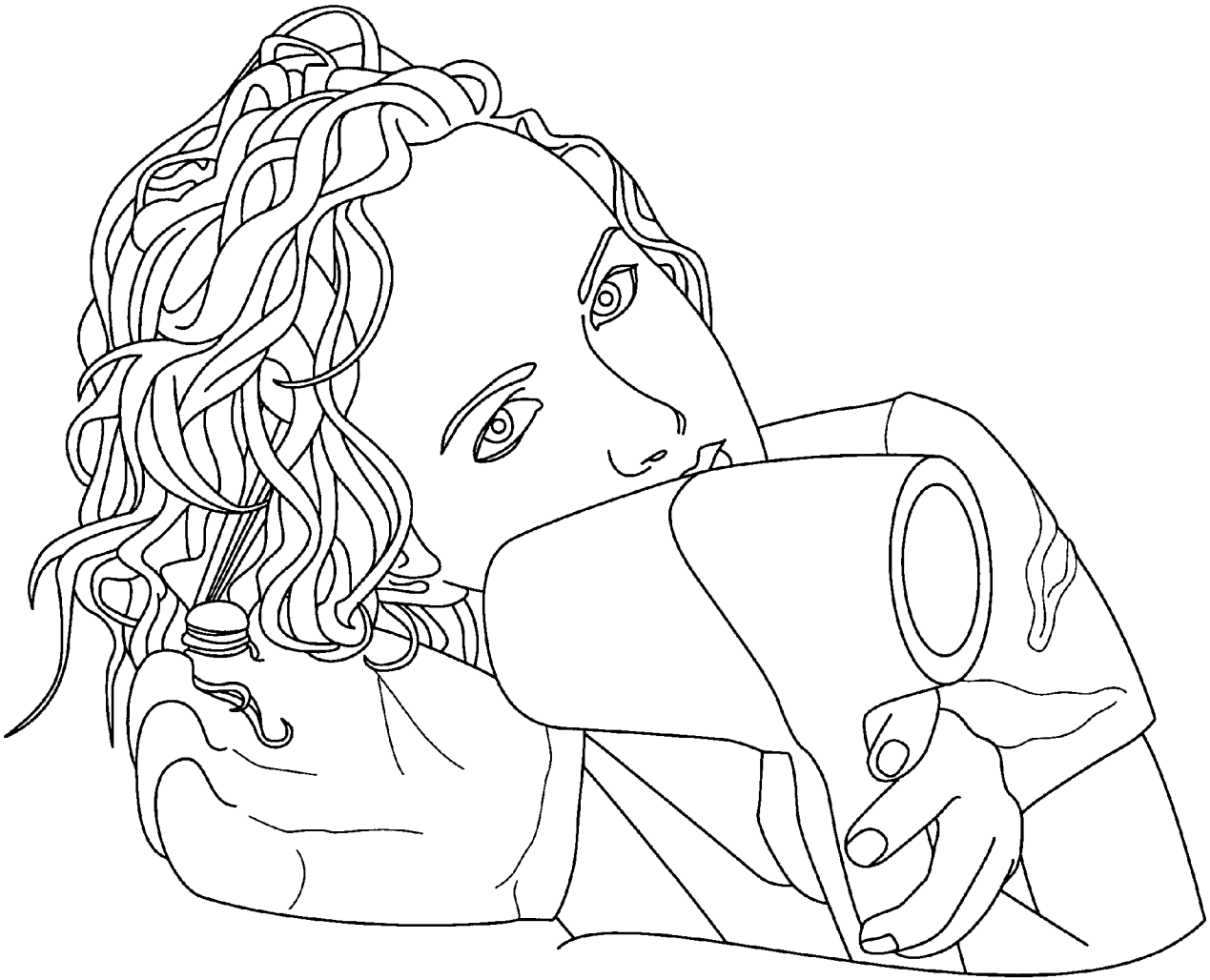
FIG. 4 illustrates another technique which can be used in conjunction with the glove of FIG. 1 for styling curly hair wherein the hair is wrapped around the fingers of the glove to produce the curls.

Another technique for styling hair to produce curls involves curling the hair around and/or between the fingers of the glove. FIG. 4 shows a person's hair being curled into a desired shape between the fingers of the glove. The hair could be simply bent around a finger for a loose curl, or, as shown in FIG. 4, the hair could be completely wrapped around a finger one or more times for a tighter curl. While this technique may be desirable under some circumstances, compressing the hair in the palm of the glove has been found to produce curls with a lesser amount of frizzing at the end of the clumps than when the hair is curled between the fingers. When the hair is wrapped around a finger several times for a tighter curl, this technique is similar to the use of a roller to curl hair, but is more flexible because individual clumps of hair can be easily manipulated in a highly individualized manner.

Figure 5:
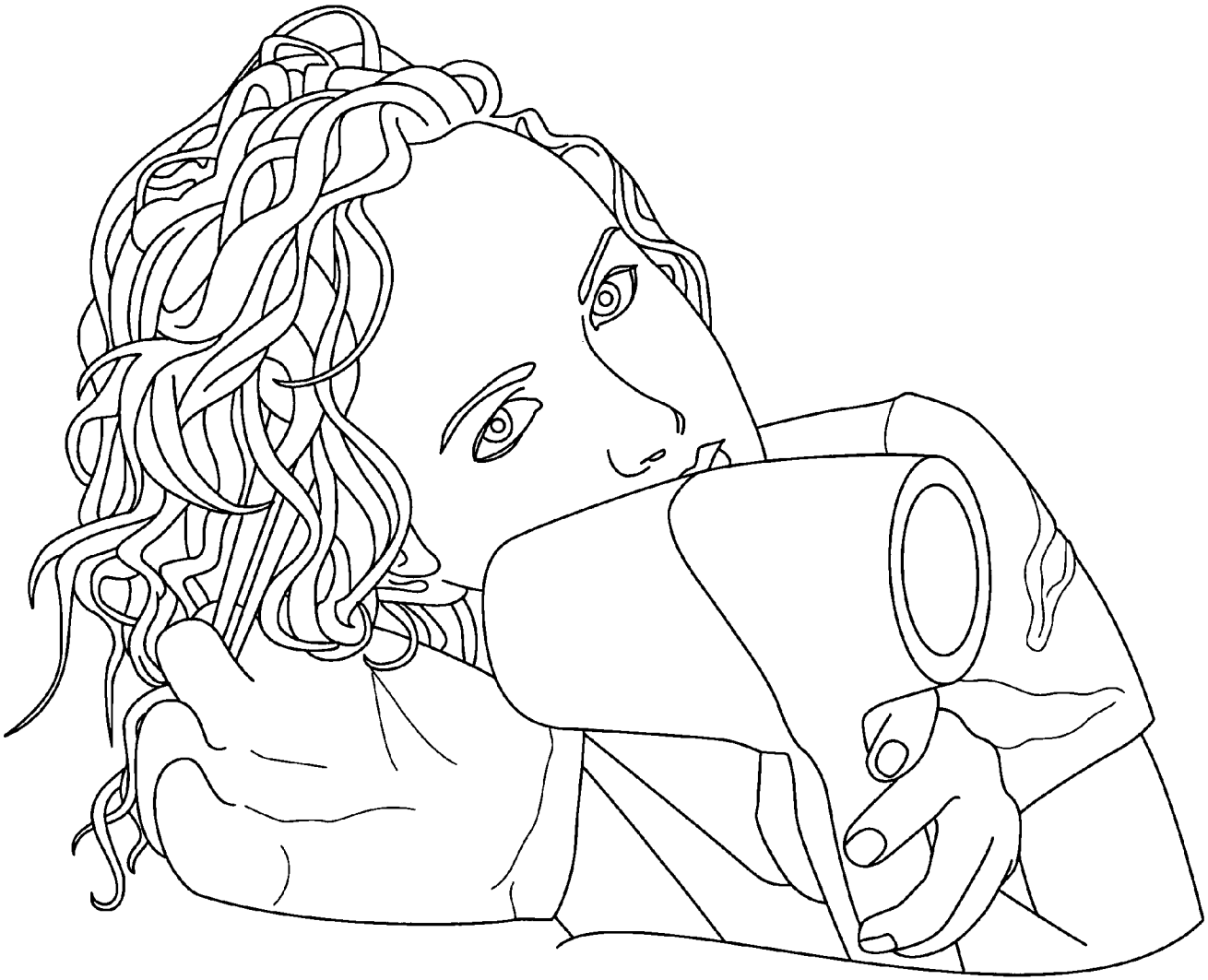
FIG. 5 illustrates another technique which can be used in conjunction with the glove of FIG. 1 for straight hair wherein the hair is held between the fingers of the glove and tensioned to straighten it.

Other techniques for styling straight hair may also include use of the glove. For example and as shown in FIG. 5, one technique begins by holding the hair between the fingers at a middle portion along the length of the hair or at the roots. Then hot air can be applied while sliding the hair from its middle portion or roots to its ends through the glove's fingers while maintaining tension on the hair. This technique may help straighten otherwise curly hair.

One aspect of the invention is that the contact of the person's wet hair with the glove while styling causes some of the water in the hair to be wicked into and absorbed by the glove. This removal of some moisture from the hair helps speed the process of drying. If a fixing agent (examples include products commonly called moose, hair gel, and hair spray) is applied to the hair, the glove may also absorb or collect some of the fixing agent and redistribute the fixing agent more evenly throughout the person's hair.

While the glove is styling the hair, hot air can be applied to the hair to dry it. Because the hair is drying at an increased rate due to the wicking of moisture away by the glove, the drying time of the hair is decreased which facilitates the hair drying while curled and then remaining curled. Another aspect of the use of the glove is that the glove can deflect a stream of hot air applied to the hair, both diffusing the flow of air (causing it to flow in a more random manner and at a slower speed) and deflecting the hot air back onto the hair.

The glove has some friction with the hair which can permit the glove to effectively grab onto portions of the clumps of hair and effectively manipulate the hair as desired.

The glove works better than use of a comb or brush to style a person's hair while drying because a comb or brush tends to separate the clumps of hair and cause frizziness. The glove works better than using bare fingers alone to manipulate the hair while drying because the glove can wick moisture away from the hair speeding the drying process.

Additionally, the glove may find use with those who wish to curl their hair with a curling iron, hot rollers, etc. The glove may allow the person to effectively manipulate the hair wrapped around the curling iron, hot rollers, etc. without burning the person's skin and while absorbing moisture to speed the drying.

Figure 6:
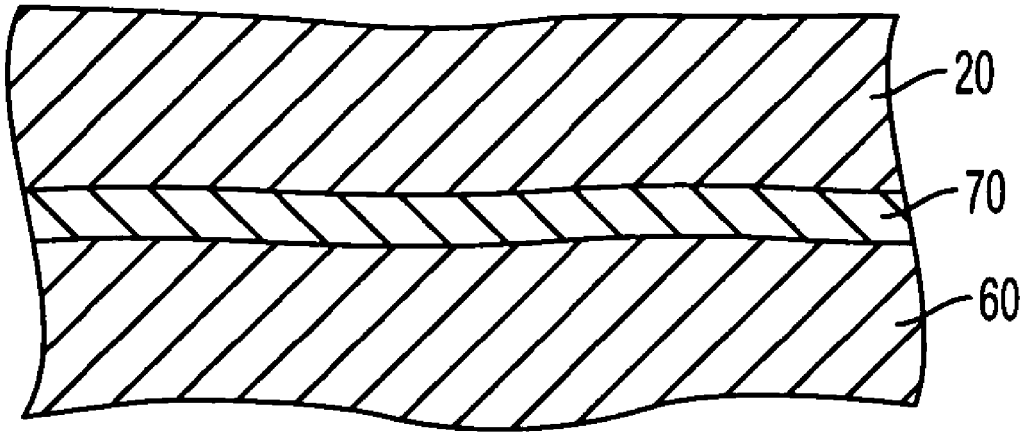
FIG. 6 illustrates a schematic sectional view of the absorbent and insulative layers which can be included in the glove of FIG. 1.

It may be desirable for the glove to include an inside layer of insulative material separate from the outside absorbent layer to protect the person's hand from being burned by the hot air, curling iron, or hot rollers. In one embodiment, the entire inside surface of the glove can be covered with an insulative layer 60 made from insulative material. In other embodiments, only a portion of the inside surface of the glove may be covered with the insulative layer 60 that still provides effective protection from heat. Because many insulative materials can become ineffective when they are saturated with liquid, it may be desirable to include a middle layer 70 of material between the absorbent layer 20 and the insulative layer 60 that is relatively impermeable to liquid. A cross-sectional view of a portion of a glove formed with an absorbent layer 20, a middle layer 70, and an insulative layer 60 is shown in FIG. 6.

The invention has been described through reference to the specific embodiments in the drawing figures. Others will be able to adapt the invention to produce different embodiments which will also fall within the scope of invention protected hereby. The scope of the invention shall be defined by the appended claims.

I claim:

1. An absorbent glove to be worn on a person's hand for styling a person's hair, the glove comprising:

a forehand area;

a backhand area substantially opposite the forehand area;

a plurality of fingers, each finger extending away from the forehand area and the backhand area and each finger attached to the forehand area and the backhand area;

at least a portion of the glove having an outer layer of absorbent material adapted for absorbing moisture from a person's hair, an inner layer of insulative material adapted to protect a person's hands from excessive heat, and a middle layer of impermeable material which substantially prevents moisture from the absorbent layer from reaching the insulative layer;

an enlarged palm area that includes extra material, creating a loose-fitting forehand and a backhand area; and the length of the plurality of fingers is small compared to the overall size of the glove.

2. The glove of claim 1 wherein at least some of the plurality of fingers are sized to be substantially shorter than the user's fingers.

3. The glove of claim 1 wherein the plurality of fingers comprises a middle finger whose length is between 1¾ to 2¾ inches.

4. A method of styling a person's hair with a glove comprising: wearing a glove on a persons'hand;

repeatedly partially closing the glove on the person's hand around sections of wet hair of a person to hold the wet sections of hair, the partial closing of the glove causing at least some of the wet sections of hair to form a new shape;

absorbing some moisture from the wet hair into the glove; and applying hot air to dry the wet hair while the glove is holding the wet sections of hair;

the glove having an enlarged palm area that creates a loose-fitting forehand and a back-hand area and the length of the fingers being small compared to the overall size of the glove and at least a portion of the glove having an outer layer of absorbent material adapted for absorbing moisture from a person's hair, an inner layer of insulative material adapted to Protect a person's hands from excessive heat, and a middle layer of impermeable material which substantially prevents moisture from the absorbent layer from reaching the insulative layer.

5. The method of claim 4 further comprising:

initially wetting the person's hair with water and separating the person's hair into sections before use of the glove.

6. The method of claim 5 further comprising:

applying a temporary fixing agent to the person's hair to facilitate retention of the hair's shape as it is drying.

7. A method of styling a person's hair with a glove comprising:

wearing the glove on a person's hand;

using the glove on the person's hand to shape sections of wet hair on a persons'head;

absorbing moisture from the wet hair into the glove while the glove is being used to shape the wet hair; and applying hot air to the wet hair to dry it while the glove is being used as a backdrop to stabilize the shape of the wet air;

the glove having an enlarged palm area that creates a loose-fitting forehand and a back-hand area and the length of the fingers being small compared to the overall size of the glove and at least a portion of the glove having an outer layer of absorbent material adapted for absorbing moisture from a person's hair, an inner layer of insulative material adapted to Protect a person's hands from excessive heat, and a middle layer of impermeable material which substantially prevents moisture from the absorbent layer from reaching the insulative layer.

8. The method of styling a person's hair according to claim 7 further comprising:

shaping the wet hair and applying hot air to render shape.

9. The method of styling a person's hair according to claim 8 further comprising:

holding the hand wearing the glove around the wet hair to coax the wet hair into a shape.

10. The method of styling a person's hair according to claim 7 further comprising:

applying a temporary fixing agent to the hair to retain its shape.

11. The method of styling a person's hair according to claim 10 further comprising:

curving the wet hair around an upper portion of a finger of the glove to produce a bend in the hair.

12. The glove of claim 1 wherein the plurality of fingers are not separate thereby creating a mitt.

13. The method of styling a person's hair according to claim 7 further comprising:

wetting the hair on the person's head with water before separating the hair into sections and placing the sections in the glove.

14. The method of styling a person's hair according to claim 13 further comprising:

separating the hair into substantial sections while wet or damp.

15. The method of styling a person's hair according to claim 14 further comprising:

creating a shape with sections of wet hair.

16. The method of styling a person's hair according to claim 15 further comprising:

holding the hand wearing the glove around the wet sections of hair in order to stabilize the shape of the hair lying in the glove.

17. The method of styling a person's hair according to claim 14 further comprising:

applying a temporary fixing agent to the hair to retain the shape once it is dry.

18. The method of styling a person's hair according to claim 17 further comprising:

curving the wet hair around an upper portion of a finger of the glove to produce a bend in the hair.

* * * * *